United States Patent [19]

Tanaka

[11] 4,199,755

[45] Apr. 22, 1980

[54] OPTICAL SMOKE DETECTOR

[75] Inventor: Hiroshi Tanaka, Tokyo, Japan

[73] Assignee: Nittan Company, Ltd., Tokyo, Japan

[21] Appl. No.: 935,365

[22] Filed: Aug. 21, 1978

[30] Foreign Application Priority Data

Oct. 28, 1977 [JP] Japan ..... 52-129456

[51] Int. Cl.[2] ..... G08B 17/10

[52] U.S. Cl. ..... 340/630; 250/574

[58] Field of Search ..... 340/628, 630; 250/573, 250/574; 356/338, 438, 439

[56] References Cited

U.S. PATENT DOCUMENTS

| | | | |
|---|---|---|---|
| 2,877,453 | 3/1959 | Mendenhall, Jr. | 340/630 |
| 3,316,410 | 4/1967 | Meili et al. | 340/630 |
| 3,474,435 | 10/1969 | White et al. | 340/630 |
| 3,510,666 | 5/1970 | Topol | 250/574 |
| 3,534,351 | 10/1970 | Harnden, Jr. et al. | 340/630 |
| 3,543,260 | 11/1970 | Engh | 340/630 |
| 3,710,365 | 1/1973 | Barnes | 340/630 |
| 3,922,655 | 11/1975 | Lecuyer | 340/630 |
| 4,149,162 | 4/1979 | Enemark et al. | 340/630 X |

*Primary Examiner*—John W. Caldwell, Sr.
*Assistant Examiner*—Daniel Myer
*Attorney, Agent, or Firm*—Eugene E. Geoffrey, Jr.

[57] ABSTRACT

An optical smoke detector having a light source and a light detector with the light detector shielded from direct light from the source. The light source is energized by a pulse generator and the outputs of the pulse generator and the light detector are fed through electric circuitry to produce one type of signal when the device operates normally and detects smoke and another type of signal should the detector fail to function in a normal manner.

2 Claims, 1 Drawing Figure

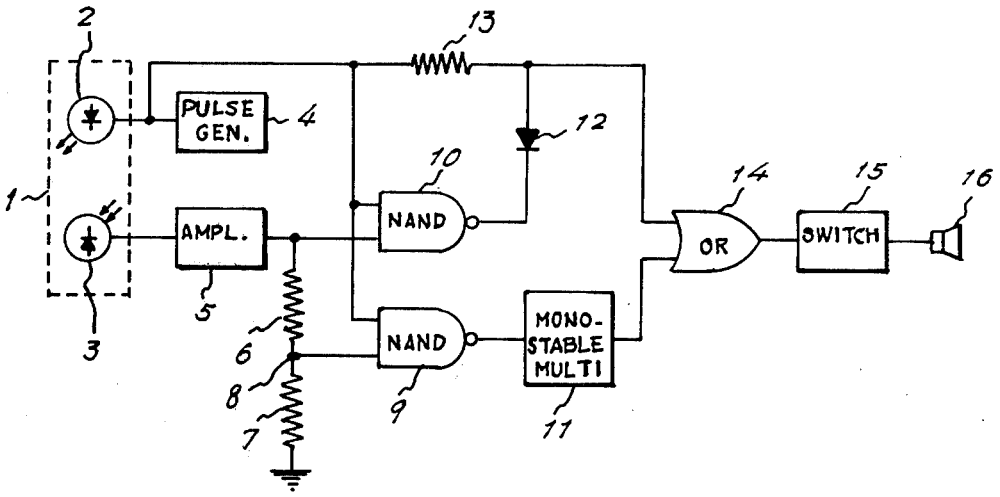
2
13
PULSE GEN.
4
12
10
14
15
16
1
AMPL.
NAND
OR
SWITCH
5
3
6
NAND
MONO-STABLE MULTI
8
9
7
11

OPTICAL SMOKE DETECTOR

This invention relates to an optical smoke detector used for detecting the outbreak of fire by sensing smoke from light scattered thereby. More particularly, this invention relates to an optical smoke detector having the function of detecting and indicating its own breakdown or other fatal trouble.

This type of optical smoke detector includes a detection chamber which allows entrance of smoke from the outside but inhibits entrance of the external light. The detection chamber includes a light source actuated by a pulse generator for emitting a pulsed light and a photoelectric element for converting a received light into an electric signal so that the light source cannot illuminate the photoelectric element directly. Although, in absence of smoke in the direction chamber, the photoelectric element produces a minimum output due to light reflected by the inner wall of the detection chamber and incident thereupon, this output is increased by the light scattered by smoke particles when smoke enters the chamber. This increased output is used as a detection signal to actuate an alarm device to produce an alarm.

When the photoelectric element and its associated circuit do not produce a sufficient level of the detection signal due to a breakdown or other trouble, the alarm device cannot be actuated even if smoke exists in the detection chamber. This results in the serious problem of misdetection of fire outbreak. Therefore, in the prior art detectors, it has been necessary to frequently and periodically make troublesome function tests in order to prevent such difficulties.

An object of this invention is to provide an improved optical smoke detector which can detect and indicate its own breakdown automatically so that the periodic function tests can be abolished.

As abovementioned, the output of the photoelectric element and its associated circuit consists generally of two parts, the first part corresponding to the light scattered by the smoke particles and the second part corresponding to the light reflected by the inner wall of the detection chamber. When the first part is reduced by breakdown or other trouble with the photoelectric element or its associated circuit, the second part is naturally reduced at the same rate. Therefore, breakdown and trouble can be detected from the reduction of the second part below a predetermined level.

The optical smoke detector according to this invention comprises first means coupled to the outputs of the pulse generator and the photoelectric element for producing a first output in response to the output pulse and the first part when the latter exceeds a predetermined level, and second means coupled also to the outputs of the pulse generator and photoelectric element for producing a second output in response to the output pulse and the second part when the latter drops below a predetermined level. The alarm device is arranged to be actuated by at least one of the first and second outputs.

Other objects and features of this invention will be described in more detail hereinunder with reference to the accompanying drawing.

The single drawing shows an embodiment of the optical smoke detector according to this invention.

Referring to the drawing, a detection chamber 1 schematically indicated by a block in broken lines includes a light source 2 such as light emitting semiconductor diode and a photoelectric element 3 such as phototransistor or photodiode. The light source 2 and the photoelectric element 3 are located in the chamber 1 so that the light source cannot illuminate directly the photoelectric element. The light source is connected to the output of a pulse generator 4 which produces a positive-going pulse train for actuating the light source and the photoelectric element 3 is connected to an amplifier 5 having known gain control means. These components are arranged so that the amplifier 5 produces a positive-going pulse train in synchronism with the positive-going pulse output of the pulse generator 4. The output of the amplifier 5 is grounded through a series resistors 6 and 7 which constitute a voltage divider network having a voltage dividing point B.

The output of the pulse generator 4 is also connected to one inputs of a pair of NAND circuits 9 and 10. These NAND circuits are of a type having predetermined input threshold level. Preferably, the each NAND circuit may be constituted in a complememtary metal oxide semiconductor integrated circuit (CMOS IC), having a threshold level determined by the source voltage as is well known in the art. The second inputs of the NAND circuits 9 and 10 are connected respectively to the voltage dividing point 8 and the output of the amplifier 5. The NAND circuits 9 and 10 are arranged to produce negative-going pulse outputs when the both inputs exceed the threshold level.

The output of the NAND circuit 9 is connected to an input of a monostable multivibrator 11 which is triggerable with a negative-going pulse input and the output of the NAND circuit 10 is connected to the cathode of a diode 12 the anode of which is connected through a resistor 13 to the output of the pulse generator 4. The output of the multivibrator 11 and the anode of the diode 12 are connected to the inputs of an OR circuit 14 the output of which is connected through a switching device 15 such as transistor to an alarm device 16 such as a buzzer.

In operation, the threshold levels of the both NAND circuits 9 and 10 are previously fixed substantially below the output level of the pulse generator 4. Then, under the normal watching condition in which no smoke exists in the detection chamber 1, the gain of the amplifier 5 is controlled so that the output level due to the abovementioned second part of the output of the photoelectric element 3, which is caused by the light reflected from the inner wall of the detection chamber 1, exceeds slightly the threshold level of the NAND circuit 10. On the other hand, the voltage dividing resistors 6 and 7 are previously selected so that the voltage appearing at the point 8 in this condition is slightly lower than the threshold level of the NAND circuit 9.

It should be understood from the above description that, in this normal watching condition, no negative-going pulse is produced from the NAND circuit 9 and, therefore, no output is produced from the monostable multivibrator. It should be understood also that, in the same condition, the NAND circuit 10 produces a negative-going pulse in synchronism with the output of the pulse generator 4. However, this negative-going pulse effectively cancels the positive-going output through the diode 12 to prevent the latter from being supplied to the OR circuit 14. Thus, in the normal watching condition, no input is supplied to the OR circuit 14 and, therefore, no alarm is produced from the alarm device 16.

When smoke comes in the detection chamber 1, the abovementioned first part of the output of the photoelectric element 3, which is caused by the light scattered by the smoke particles, increases, thereby increasing the output of the amplifier 5. This results in increase in the voltage at the point 8 above the threshold level of the NAND circuit 9, thereby producing a negative-going output pulse from the NAND circuit 9. Thus, the monostable multivibrator 11 is triggered thereby to produce an intermittent signal which in turn drives the alarm device 15 intermittently.

If the photoelectric element 3 or the amplifier 5 is broken down or otherwise deteriorated such that the output of the amplifier 5 is weakened, the voltage at the point 8 is correspondingly reduced to become lower than the threshold value of the NAND circuit 9. Thus, the output of the NAND circuit 9 is interrupted and no alarm is produced. In this condition, however, the input of the NAND circuit 10 from the amplifier 5 drops also below the threshold level of the NAND circuit 10 and the output of the NAND circuit 10 is also interrupted. Thus, the cancellation of the output pulse of the pulse generator 4 does not occur and the alarm device 16 is driven by the output of the pulse generator 4 through the OR circuit 14 and switching device 15. In this case, the alarm signal appears as periodic shot noises synchronous with the output of the pulse generator 4 in contrast with the aforementioned smoke detection signal appearing intermittently. It is easily understood that the breakdown detection signal is produced not only when smoke exists in the detection chamber 1 but also in the normal watching condition in which no smoke exists.

As described above, according to this invention, any fatal defect in the light sensing unit of the optical smoke detector can be detected automatically without the need for any function test.

It should be noted that the above description is made for illustrative purposes only and various modifications and changes can be made without departing from the scope and spirit of this invention as defined in the appended claims. For example, it is regarded that the components 9 and 11 constitute a logic AND circuit and the components 10 and 12 constitute a logic exclusive OR circuit. Therefore, various alternatives serving the same function can be designed readily by those skilled in the art. Moreover, the two inputs of the OR circuit 14 may be processed separately through individual alarm channels so as to clearly distinguish the smoke and breakdown detection signals in visual and/or audible fashion.

What is claimed:

1. An optical smoke detector comprising a detection chamber allowing entrance of smoke but inhibiting entrance of external light, a pulse generator for producing a pulsed output, a light source connected to said pulse generator and actuated by said pulsed output for emitting a pulsed light in said detection chamber, a light sensing device including a photoelectric element located so that it is not illuminated directly by said light source but can receive a first part of said pulsed light which is scattered by the smoke and a second part thereof which is reflected by the inner wall of said detection chamber for producing a detection output consisting of first and second parts which correspond respectively to said first and second parts of the pulsed light, first means coupled to the outputs of said pulse generator and light sensing device for producing a first output in response to said pulsed output and said first part of the detection output when said first part exceeds a predetermined level, second means coupled to the outputs of said pulse generator and light sensing device for producing a second output in response to said pulsed output and said second part of detection output when said second part drops below a predetermined level, and an alarm device actuated by at least one of said first and second outputs.

2. An optical smoke detector, according to claim 1, wherein said first means includes a logic AND circuit, said second means includes a logic exclusive OR circuit, the output of said pulse generator is connected to an input of both said AND circuit and exclusive OR circuit, the output of said light sensing device is connected directly to another input of said exclusive OR circuit and connected through a voltage dividing circuit to another input of said AND circuit, and said alarm device is actuated by at least one of the outputs of said AND and exclusive OR circuits.

* * * * *